US012397891B2

(12) United States Patent
Hikosaka

(10) Patent No.: US 12,397,891 B2
(45) Date of Patent: Aug. 26, 2025

(54) OUTBOARD MOTOR AND DRIVE SHAFT ASSEMBLING METHOD

(71) Applicant: SUZUKI MOTOR CORPORATION, Hamamatsu (JP)

(72) Inventor: Tomokazu Hikosaka, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 469 days.

(21) Appl. No.: 18/081,343

(22) Filed: Dec. 14, 2022

(65) Prior Publication Data

US 2023/0202634 A1 Jun. 29, 2023

(30) Foreign Application Priority Data

Dec. 23, 2021 (JP) ..... 2021-209506

(51) Int. Cl.
*B63H 20/14* (2006.01)
*B63H 20/32* (2006.01)

(52) U.S. Cl.
CPC ..... *B63H 20/14* (2013.01); *B63H 2020/323* (2013.01)

(58) Field of Classification Search
CPC ... B63H 20/14; B63H 20/32; B63H 2020/323
See application file for complete search history.

(56) References Cited

U.S. PATENT DOCUMENTS 2,009,628 A * 7/1935 Magney ..... B63H 20/14 74/370
2,679,909 A * 6/1954 Kiekhaefer ..... B63H 20/14 416/169 R
11,364,987 B1 * 6/2022 Foulkes ..... B63H 23/08
2016/0137280 A1 5/2016 Sugiyama et al.

FOREIGN PATENT DOCUMENTS

JP 2016-94116 A 5/2016

* cited by examiner

*Primary Examiner* — Stephen P Avila
(74) *Attorney, Agent, or Firm* — Stein IP, LLC

(57) ABSTRACT

An outboard motor includes a case having a gear chamber, a drive shaft arrangement hole, and a propeller shaft arrangement hole, a drive shaft, a propeller shaft, a drive gear, a driven gear, a gear position setting member provided in front of the driven gear in the case and configured to set a position of the driven gear in a front-rear direction, and a screw mechanism configured to move the gear position setting member in the front-rear direction when the gear position setting member is rotated about an axis of the gear position setting member. The screw mechanism includes a first screw provided in the case and a second screw provided on the gear position setting member and configured to be screwed with the first screw.

5 Claims, 10 Drawing Sheets

OUTBOARD MOTOR AND DRIVE SHAFT ASSEMBLING METHOD

CROSS-REFERENCE TO RELATED APPLICATIONS

The disclosure of Japanese Patent Application No. 2021-209506 filed on Dec. 23, 2021, including specification, drawings and claims is incorporated herein by reference in its entirety.

TECHNICAL FIELD

The present disclosure relates to an outboard motor and a drive shaft assembling method for assembling a drive shaft integrally formed with a drive gear to a lower case of an outboard motor.

BACKGROUND ART

Many outboard motors include a power source provided at an upper portion of an outboard motor, a drive shaft extending downward from the power source, a propeller shaft provided at a lower portion of the outboard motor and extending in a front-rear direction, a propeller attached to the propeller shaft, and a gear mechanism provided at the lower portion of the outboard motor and configured to transmit rotation of the drive shaft to the propeller shaft.

In such an outboard motor, the gear mechanism and the like are disposed in a lower case provided at the lower portion of the outboard motor. Specifically, a gear chamber is provided in the lower case, and the gear mechanism is accommodated in the gear chamber. The lower case is provided with a drive shaft arrangement hole communicating with the gear chamber from above the gear chamber, and the drive shaft is disposed in the drive shaft arrangement hole. The lower case is provided with a propeller shaft arrangement hole communicating with the gear chamber from rear of the gear chamber, and the propeller shaft is disposed in the propeller shaft arrangement hole.

The gear mechanism includes a drive gear coupled to a lower end portion of the drive shaft and a driven gear coupled to a front end portion of the propeller shaft. To transmit the rotation of the drive shaft extending in an upper-lower direction to the propeller shaft extending in the front-rear direction, bevel gears are used as the drive gear and the driven gear. The gear mechanism of many outboard motors includes two driven gears. That is, the gear mechanism of a contra-rotating propeller outboard motor includes two driven gears to transmit the rotation of the drive shaft to each of two propeller shafts. Also in an outboard motor including one propeller shaft, the gear mechanism is provided with two driven gears in many cases to switch the direction of the rotation transmitted from the drive shaft to the propeller shaft by a clutch. In both the gear mechanism of the contra-rotating propeller outboard motor and the gear mechanism of the outboard motor including one propeller shaft, one of the two driven gears is disposed in front of the drive gear and meshes with the drive gear from front of the drive gear, and the other driven gear is disposed in rear of the drive gear and meshes with the drive gear from rear of the drive gear.

In the contra-rotating propeller outboard motor having such a configuration in the related art, the drive shaft and the drive gear are separately formed, and the drive gear is fitted to the lower end portion of the drive shaft. The propeller shaft and the driven gear are also separately formed, and the driven gear is fitted to the front end portion of the propeller shaft. In addition, in the outboard motor having the above-described configuration of including one propeller shaft in the related art, the drive shaft and the drive gear are separately formed, and the drive gear is fitted to the lower end portion of the drive shaft. In the outboard motor including one propeller shaft, each driven gear is coupled to the propeller shaft by a clutch. Due to this structure, the driven gear and the propeller shaft are separately formed.

A contra-rotating propeller outboard motor (1) shown in FIG. 2 of Patent Literature 1 below includes a pinion gear (18) and a lower drive shaft (172). The pinion gear (18) corresponds to a drive gear, and the lower drive shaft (172) corresponds to a drive shaft. In the outboard motor (1), the lower drive shaft (172) and the pinion gear (18) are formed separately, and the pinion gear (18) is fitted to the lower drive shaft (172). The outboard motor (1) further includes a front gear (21), a rear gear (22), an inner shaft (231), and an outer shaft (232). The front gear (21) and the rear gear (22) correspond to driven gears, and the inner shaft (231) and the outer shaft (232) correspond to propeller shafts. In the outboard motor (1), the inner shaft (231) and the front gear (21) are formed separately, and the front gear (21) is fitted to the inner shaft (231). The outer shaft (232) and the rear gear (22) are separately formed, and the rear gear (22) is fitted to the outer shaft (232). The above-described reference numerals in parentheses are reference numerals described in Patent Literature 1.

Patent Literature 1: JP2016-94116A

In the outboard motors in the related art, the drive shaft and the drive gear are separately formed, and the drive gear is fitted to the lower end portion of the drive shaft. However, when the torque of the power source is increased, it may be difficult to stabilize the transmission of the power of the power source from the drive shaft to the propeller shaft with a structure in which the drive gear is fitted to the drive shaft. Therefore, it is conceivable to integrally form the drive gear with the drive shaft. By integrally forming the drive gear with the drive shaft, the coupling strength between the drive shaft and the drive gear can be increased, and the stability of power transmission from the drive shaft to the propeller shaft can be increased.

However, when the drive gear is integrally formed with the drive shaft, it may be difficult to assemble the drive shaft and the drive gear into the lower case.

For example, in the above-described contra-rotating propeller outboard motor in the related art, the operation of assembling the drive shaft, the two propeller shafts, the drive gear, and the two driven gears into the lower case is generally performed as follows. First, of the two driven gears, the driven gear disposed in front of the drive gear (hereinafter referred to as the "front driven gear") is inserted into the gear chamber through the propeller shaft arrangement hole from rear of the lower case, and is attached to the inside of the gear chamber. Next, the drive gear is inserted into the gear chamber through the propeller shaft arrangement hole from rear of the lower case, and the drive shaft is inserted through the drive shaft arrangement hole from above the lower case. In the gear chamber, the drive gear is fitted to the lower end portion of the drive shaft while being meshed with the front driven gear, and the drive shaft is attached to the drive shaft arrangement hole. Next, the driven gear disposed in rear of the drive gear and the two propeller shafts are inserted into the propeller shaft arrangement hole from rear of the lower case, and are assembled into the gear chamber or the propeller shaft arrangement hole.

When the drive gear is integrally formed with the drive shaft, the drive shaft integrally formed with the drive gear needs to be assembled into the lower case. As a method for assembling the drive shaft integrally formed with the drive gear into the lower case, the following two methods are conceivable.

As shown in FIG. 10A, the first method is a method in which a drive shaft 122 integrally formed with a drive gear 121 is inserted into a drive shaft arrangement hole 126 from above a lower case 123, the drive gear 121 is inserted into a gear chamber 125, and the drive shaft 122 is attached to the inside of the drive shaft arrangement hole 126.

In the second method, as shown in FIG. 10B, the drive shaft 122 integrally formed with the drive gear 121 is inserted into the gear chamber 125 from rear of the lower case 123 through a propeller shaft arrangement hole 124, and the drive shaft 122 is inserted into the drive shaft arrangement hole 126 from below and attached to the inside of the drive shaft arrangement hole 126.

However, it is difficult to adopt the first method for the following reason. That is, as can be seen from FIG. 10A, the drive shaft arrangement hole 126 has a diameter smaller than a diameter of the drive gear 121, and thus the drive gear 121 cannot be inserted into the drive shaft arrangement hole 126. Therefore, by the first method, the drive shaft 122 integrally formed with the drive gear 121 cannot be assembled into the lower case 123. In this regard, increasing the diameter of the drive shaft arrangement hole 126 to be larger than the diameter of the drive gear 121 allows the drive shaft 122 integrally formed with the drive gear 121 to be assembled into the lower case 123. However, when the diameter of the drive shaft arrangement hole 126 is larger than the diameter of the drive gear 121, the lateral width of the lower case 123 increases and the resistance to water during navigation increases. Therefore, it is not preferable to increase the diameter of the drive shaft arrangement hole 126 to be larger than the diameter of the drive gear 121.

In addition, it is difficult to adopt the second method for the following reason. That is, as shown in FIG. 10B, a front driven gear 127 needs to be attached to the inside of the gear chamber 125 before the drive shaft 122 integrally formed with the drive gear 121 is inserted into the propeller shaft arrangement hole 124. In a state in which the front driven gear 127 is attached to the inside of the gear chamber 125, the front driven gear 127 becomes an obstacle, and the drive shaft 122 integrally formed with the drive gear 121 cannot be inserted into the drive shaft arrangement hole 126 from below.

The present disclosure is made in view of, for example, the above-described problems, and an object of the present disclosure is to provide an outboard motor and a drive shaft assembling method in which a drive shaft and a drive gear can be assembled into a lower case even when the drive gear is integrally formed with the drive shaft.

SUMMARY

In order to solve the above problem, there is provided an outboard motor including: a case having a gear chamber, a drive shaft arrangement hole communicating with the gear chamber from above the gear chamber, and a propeller shaft arrangement hole communicating with the gear chamber from rear of the gear chamber; a drive shaft disposed in the drive shaft arrangement hole and extending in an upper-lower direction; a propeller shaft disposed in the propeller shaft arrangement hole and extending in a front-rear direction; a drive gear disposed in the gear chamber and coupled to a lower end side of the drive shaft, the drive gear being a bevel gear; a driven gear disposed in front of the drive gear in the gear chamber, coupled to a front end side of the propeller shaft, and configured to mesh with the drive gear, the driven gear being a bevel gear; a gear position setting member provided in front of the driven gear in the case and configured to set a position of the driven gear in the front-rear direction; and a screw mechanism configured to move the gear position setting member in the front-rear direction when the gear position setting member is rotated about an axis of the gear position setting member, the axis of the gear position setting member extending in the front-rear direction. The screw mechanism includes a first screw provided in the case and having an axis extending in the front-rear direction and a second screw provided on the gear position setting member, having an axis extending in the front-rear direction, and configured to be screwed with the first screw.

In order to solve the above problem, there is provided a drive shaft assembling method for an outboard motor, the outboard motor including: a case having a gear chamber, a drive shaft arrangement hole communicating with the gear chamber from above the gear chamber, and a propeller shaft arrangement hole communicating with the gear chamber from rear of the gear chamber; a drive shaft disposed in the drive shaft arrangement hole and extending in an upper-lower direction; a propeller shaft disposed in the propeller shaft arrangement hole and extending in a front-rear direction; a drive gear disposed in the gear chamber and integrally formed with a lower end side of the drive shaft, the drive gear being a bevel gear; a driven gear disposed in front of the drive gear in the gear chamber, coupled to a front end side of the propeller shaft, and configured to mesh with the drive gear, the driven gear being a bevel gear; a gear position setting member provided in front of the driven gear in the case and configured to set a position of the driven gear in the front-rear direction; and a screw mechanism configured to move the gear position setting member in the front-rear direction when the gear position setting member is rotated about an axis of the gear position setting member that extends in the front-rear direction, the drive shaft assembling method for assembling the drive shaft integrally formed with the drive gear into the case, and the drive shaft assembling method including: inserting the drive shaft into the drive shaft insertion hole from the gear chamber after inserting the drive shaft into the gear chamber through the propeller shaft insertion hole in a state where the driven gear is disposed in front of a set position where the driven gear is meshed with the drive gear; inserting a tool that rotates the gear position setting member into the gear chamber through the propeller shaft insertion hole and attaching the tool to the gear position setting member; and rotating the gear position setting member by the tool to move the driven gear to the set position to mesh with the drive gear.

DESCRIPTION OF EMBODIMENTS

Figure 1:
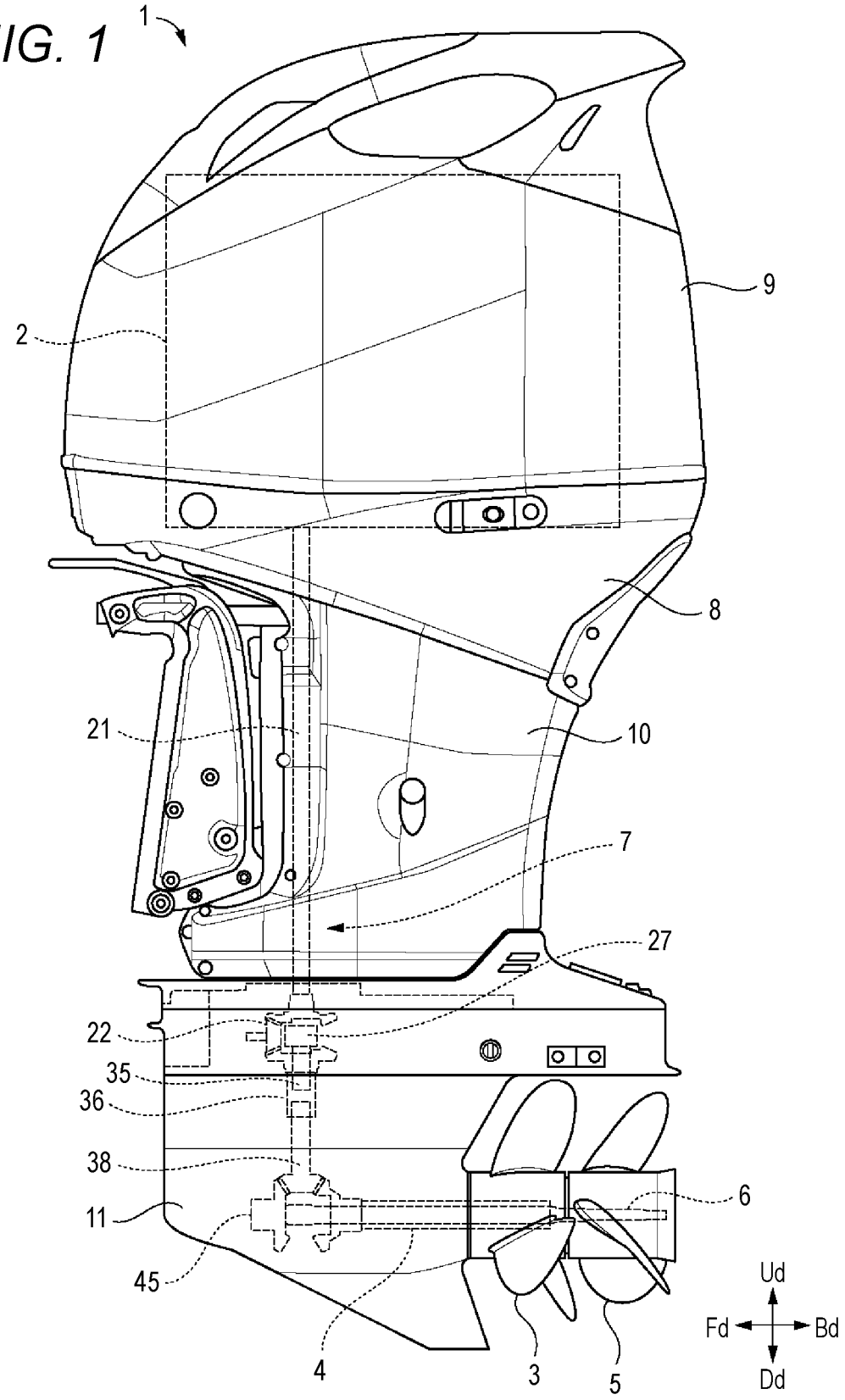
FIG. 1 is an overall view showing an outboard motor according to an embodiment of the present disclosure.

An outboard motor according to an embodiment of the present disclosure includes: a case having a gear chamber, a drive shaft arrangement hole communicating with the gear chamber from above the gear chamber, and a propeller shaft arrangement hole communicating with the gear chamber from rear of the gear chamber; a drive shaft disposed in the drive shaft arrangement hole and extending in an upper-lower direction; and a propeller shaft disposed in the propeller shaft arrangement hole and extending in a front-rear direction. The outboard motor according to the embodiment of the present disclosure further includes a drive gear and a driven gear. The drive gear is disposed in the gear chamber and coupled to a lower end side of the drive shaft. The drive gear is a bevel gear. The driven gear is disposed in front of the drive gear in the gear chamber and coupled to a front end side of the propeller shaft. The driven gear is a bevel gear and meshes with the drive gear. The outboard motor according to the embodiment of the present disclosure further includes a gear position setting member and a screw mechanism. The gear position setting member is a member that is provided in front of the driven gear in the case and that sets a position of the driven gear in the front-rear direction. The screw mechanism is a mechanism that moves the gear position setting member in the front-rear direction when the gear position setting member is rotated about an axis of the gear position setting member that extends in the front-rear direction. The screw mechanism includes a first screw provided in the case and having an axis extending in the front-rear direction, and a second screw provided on the gear position setting member, having an axis extending in the front-rear direction, and screwed with the first screw.

According to the outboard motor of the present embodiment, the drive shaft can be assembled into the case even when the drive gear is integrally formed with the drive shaft. That is, by rotating the gear position setting member about the axis and moving the gear position setting member forward, the driven gear disposed in the gear chamber can be moved forward. When the driven gear moves forward, the driven gear moves away from the opening of the drive shaft arrangement hole into the gear chamber that communicates with the inside of the gear chamber. As a result, a vacant region below the drive shaft arrangement hole expands in the gear chamber. Therefore, after the driven gear is moved forward, the drive shaft integrally formed with the drive gear is inserted into the gear chamber from rear of the case through the propeller shaft arrangement hole, and the drive shaft is inserted into the drive shaft arrangement hole from below and attached to the inside of the drive shaft arrangement hole. Thereafter, the gear position setting member is rotated in an opposite direction, the driven gear is moved rearward together with the gear position setting member, so that the driven gear can be meshed with the drive gear.

A drive shaft assembling method according to the embodiment of the present disclosure is a method in which, in the outboard motor according to the embodiment of the present disclosure including the drive gear integrally formed with the drive shaft on the lower end side of the drive shaft, the drive shaft integrally formed with the drive gear is assembled into the case. The drive shaft assembling method according to the embodiment of the present disclosure includes: a drive shaft inserting step of inserting the drive shaft into the drive shaft insertion hole from the gear chamber after inserting the drive shaft into the gear chamber though the propeller shaft insertion hole in a state where the driven gear is disposed in front of a set position where the driven gear is meshed with the drive gear; a tool attaching step of inserting a tool that rotates the gear position setting member into the gear chamber through the propeller shaft insertion hole and attaching the tool to the gear position setting member; and a driven gear moving step of rotating the gear position setting member by the tool to move the driven gear to the set position to mesh with the drive gear. According to the drive shaft assembling method of the present embodiment, the drive shaft integrally formed with the drive gear can be easily assembled into the case.

EMBODIMENTS

An outboard motor according to an embodiment of the present disclosure will be described. Upper (Ud), lower (Dd), front (Fd), rear (Bd), left (Ld), and right (Rd) directions described in the embodiment follow arrows drawn on lower right of FIGS. 1 to 8D.

Outboard Motor

FIG. 1 shows an outboard motor 1 according to the embodiment of the present disclosure. As shown in FIG. 1, the outboard motor 1 is a contra-rotating propeller outboard motor. The outboard motor 1 includes an engine 2 that is a power source, a front propeller 3, an outer propeller shaft 4 to which the front propeller 3 is attached, a rear propeller 5, an inner propeller shaft 6 to which the rear propeller 5 is attached, and a power transmission mechanism 7 that transmits power of the engine 2 to the propeller shafts 4, 6. The engine 2 is disposed at an upper portion of the outboard motor 1, the propeller shafts 4, 6 are disposed at a lower portion of the outboard motor 1, and the power transmission mechanism 7 is disposed between the engine 2 and the propeller shafts 4, 6. The power transmission mechanism 7 includes an upper drive shaft 21, an upper gear mechanism 22, a clutch 27, an intermediate drive shaft 35, a coupling member 36, a lower drive shaft 38, and a lower gear mechanism 45.

The engine 2 is covered with a bottom cowl 8 and a top cowl 9. The upper drive shaft 21 is disposed in an upper case 10. The upper gear mechanism 22, the clutch 27, the intermediate drive shaft 35, the coupling member 36, the lower drive shaft 38, and the lower gear mechanism 45 are disposed in a lower case 11 provided at the lower portion of the outboard motor 1. Front end portions of the outer propeller shaft 4 and the inner propeller shaft 6 are disposed in the lower case 11. The lower case 11 is a specific example of a "case", and the lower drive shaft 38 is a specific example of a "drive shaft". The outer propeller shaft 4 and the inner propeller shaft 6 are specific examples of a "propeller shaft".

Lower Case

Figure 2:
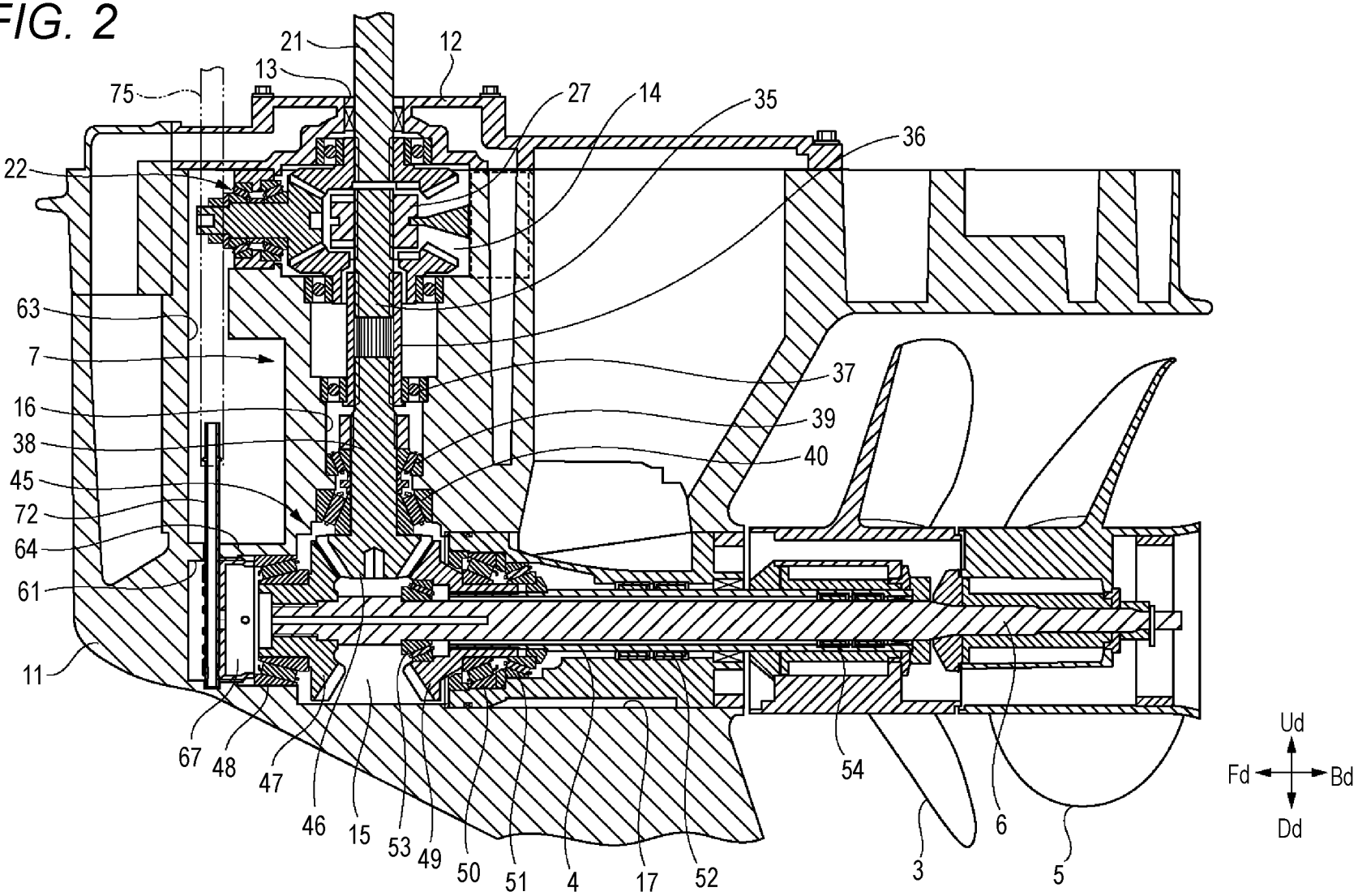
FIG. 2 is a sectional view showing the inside of a lower portion of the outboard motor according to the embodiment of the present disclosure.

FIG. 2 shows a cross section as viewed from left, which is obtained by cutting components provided at the lower portion of the outboard motor 1 along a plane including axes of the drive shafts 21, 35, 38 and the propeller shafts 4, 6 and extending in the front-rear direction and the upper-lower direction. In FIG. 2, the lower case 11 is formed in a substantially box shape having an opened upper portion, and is provided with, at the upper portion of the lower case 11, a lid member 12 that covers a part of the upper portion of the lower case 11. The lid member 12 is formed with a drive shaft insertion hole 13.

The lower case 11 is provided with an upper gear chamber 14 at a front upper portion therein. The drive shaft insertion hole 13 communicates with the upper gear chamber 14. The lower case 11 is provided with a lower gear chamber 15 at a front lower portion. The lower case 11 is formed with a drive shaft arrangement hole 16 between the upper gear chamber 14 and the lower gear chamber 15, which connects the upper gear chamber 14 and the lower gear chamber 15. The drive shaft arrangement hole 16 extends in the upper-lower direction and communicates with the lower gear chamber 15 from above the lower gear chamber 15. The lower case 11 is formed with a propeller shaft arrangement hole 17 in rear of the lower gear chamber 15. The propeller shaft arrangement hole 17 extends in the front-rear direction and communicates with the lower gear chamber 15 from rear of the lower gear chamber 15. The lower gear chamber 15 is a specific example of a "gear chamber".

Upper Drive Shaft

As shown in FIG. 1, the upper drive shaft 21 extends in the upper-lower direction, and an upper end of the upper drive shaft 21 is connected to the engine 2. As shown in FIG. 2, a lower end of the upper drive shaft 21 is inserted into the drive shaft insertion hole 13. The upper drive shaft 21 rotates in one direction by the power of the engine 2. The rotation direction of the upper drive shaft 21 is defined as a positive direction.

Upper Gear Mechanism and Clutch

Figure 3:
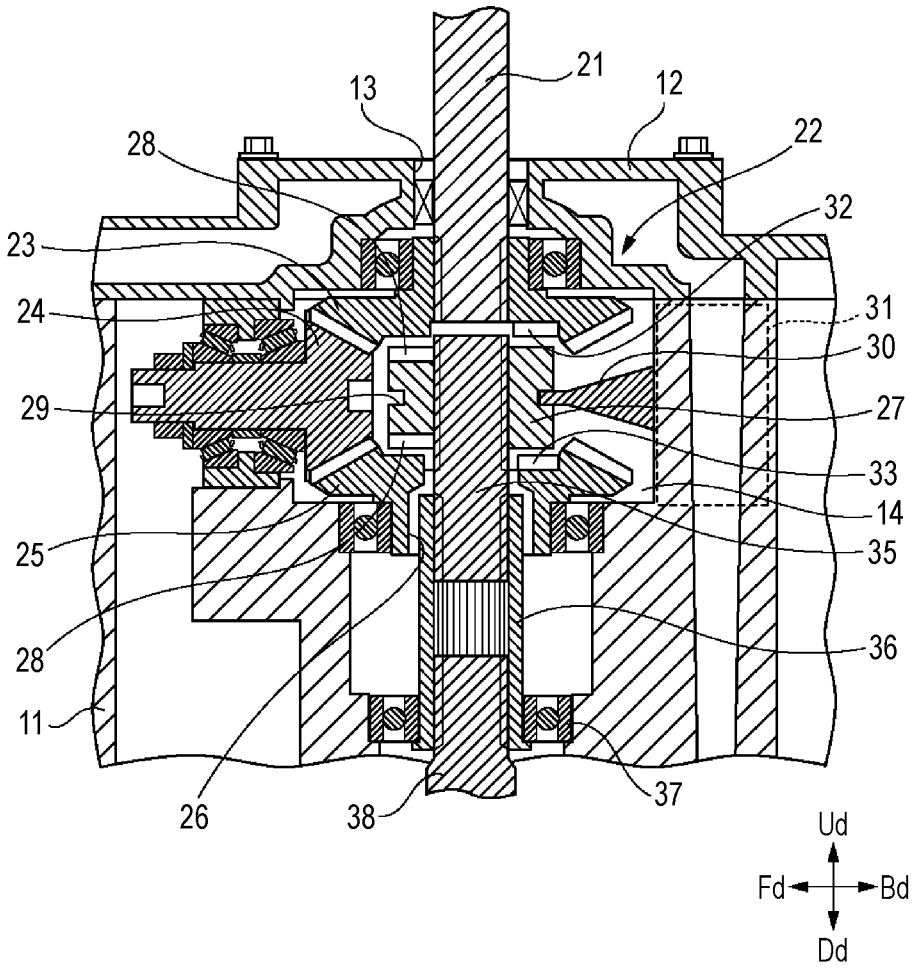
FIG. 3 is a sectional view showing an enlarged upper gear mechanism, an enlarged clutch, and the like in FIG. 2.

FIG. 3 is an enlarged view of the upper gear mechanism 22, the clutch 27, and the like in FIG. 2. The upper gear mechanism 22 is a mechanism that generates rotation in a reverse direction relative to the rotation of the upper drive shaft 21. The upper gear mechanism 22 is disposed in the upper gear chamber 14. As shown in FIG. 3, the upper gear mechanism 22 includes a reverse drive gear 23, a reverse intermediate gear 24, and a reverse output gear 25.

The reverse drive gear 23, which is a bevel gear, is disposed at an upper portion of the upper gear chamber 14 such that a portion formed with teeth faces downward, and is rotatably supported to the lid member 12 by a bearing. The reverse drive gear 23 is, for example, splined (fitted) to a lower end portion of the upper drive shaft 21, and rotates integrally with the upper drive shaft 21.

The reverse intermediate gear 24 is a bevel gear and is disposed at a front portion of the upper gear chamber 14 such that a portion formed with teeth faces rearward. The reverse intermediate gear 24 is integrally formed with a shaft, and the shaft of the reverse intermediate gear 24 is rotatably supported to the lower case 11 by a bearing.

The reverse output gear 25, which is a bevel gear, is disposed at a lower portion of the upper gear chamber 14 such that a portion formed with teeth faces upward, and is rotatably supported to the lower case 11 by a bearing. The reverse output gear 25 is formed with a through hole 26 in a central portion thereof. An upper end portion of the intermediate drive shaft 35 is inserted into the through hole 26 and is moved away from the through hole 26.

The reverse drive gear 23 meshes with the reverse intermediate gear 24, and the reverse intermediate gear 24 meshes with the reverse output gear 25. When the reverse drive gear 23 rotates in the positive direction, the rotation is transmitted to the reverse output gear 25 through the reverse intermediate gear 24, and the reverse output gear 25 rotates in a reverse direction.

The clutch 27, which is a dog clutch, has a cylindrical shape, and is formed with a clutch pawl 28 on each of an upper end surface and a lower end surface. The clutch 27 is formed with a groove 29 over the entire circumference of an outer peripheral surface thereof. The clutch 27 is disposed between the reverse drive gear 23 and the reverse output gear 25. In the upper gear chamber 14, the upper end portion of the intermediate drive shaft 35 penetrates the through hole 26 of the reverse output gear 25 and enters between the reverse drive gear 23 and the reverse output gear 25. The clutch 27 is coupled to the upper end portion of the intermediate drive shaft 35 in a manner of being not movable in a circumferential direction and movable in an axial direction of the intermediate drive shaft 35. Accordingly, the clutch 27 and the intermediate drive shaft 35 rotate integrally, and the clutch 27 can move in the upper-lower direction relative to the intermediate drive shaft 35.

The lower case 11 is provided with a shift member 30 and a clutch control unit 31. One end of the shift member 30 is inserted into the groove 29 of the clutch 27 so that the clutch 27 is rotatable relative to the shift member 30. The other end of the shift member 30 is connected to an actuator (not shown) provided in the clutch control unit 31. When the actuator is operated, the shift member 30 can be moved in the upper-lower direction, and the clutch 27 can be moved in the upper-lower direction. When the clutch 27 moves upward, the clutch pawl 28 on the upper end surface of the clutch 27 engages with a clutch pawl 32 on a lower end surface of the reverse drive gear 23. Accordingly, the rotation of the upper drive shaft 21 is directly transmitted to the intermediate drive shaft 35, and the intermediate drive shaft 35 rotates in the positive direction. On the other hand, when the clutch 27 moves downward, the clutch claw 28 on the lower end surface of the clutch 27 engages with a clutch claw 33 on an upper end surface of the reverse output gear 25. Accordingly, the rotation of the reverse output gear 25 is transmitted to the intermediate drive shaft 35, and the intermediate drive shaft 35 rotates in the reverse direction.

(Intermediate Drive Shaft and Coupling Member)

The intermediate drive shaft 35 extends in the upper-lower direction, and is located below the upper drive shaft 21 and is coaxial with the upper drive shaft 21. The upper end portion of the intermediate drive shaft 35 is coupled to the clutch 27 as described above. A lower end portion of the intermediate drive shaft 35 is coupled to the lower drive shaft 38 by a coupling member 36. The coupling member 36 has a tubular shape, and is formed with a spline on an inner peripheral surface thereof. The intermediate drive shaft 35 is also formed with a spline on an outer peripheral surface of a lower end portion thereof. The lower drive shaft 38 is also formed with a spline on an outer peripheral surface of an upper end portion thereof. The lower end portion of the intermediate drive shaft 35 is inserted into an upper portion of the coupling member 36 and is splined (fitted) to the coupling member 36. The upper end portion of the lower drive shaft 38 is inserted into a lower portion of the coupling member 36 and is splined (fitted) to the coupling member 36. The coupling member 36 is rotatably supported to the lower case 11 by a bearing 37.

(Lower Drive Shaft)

Figure 4:
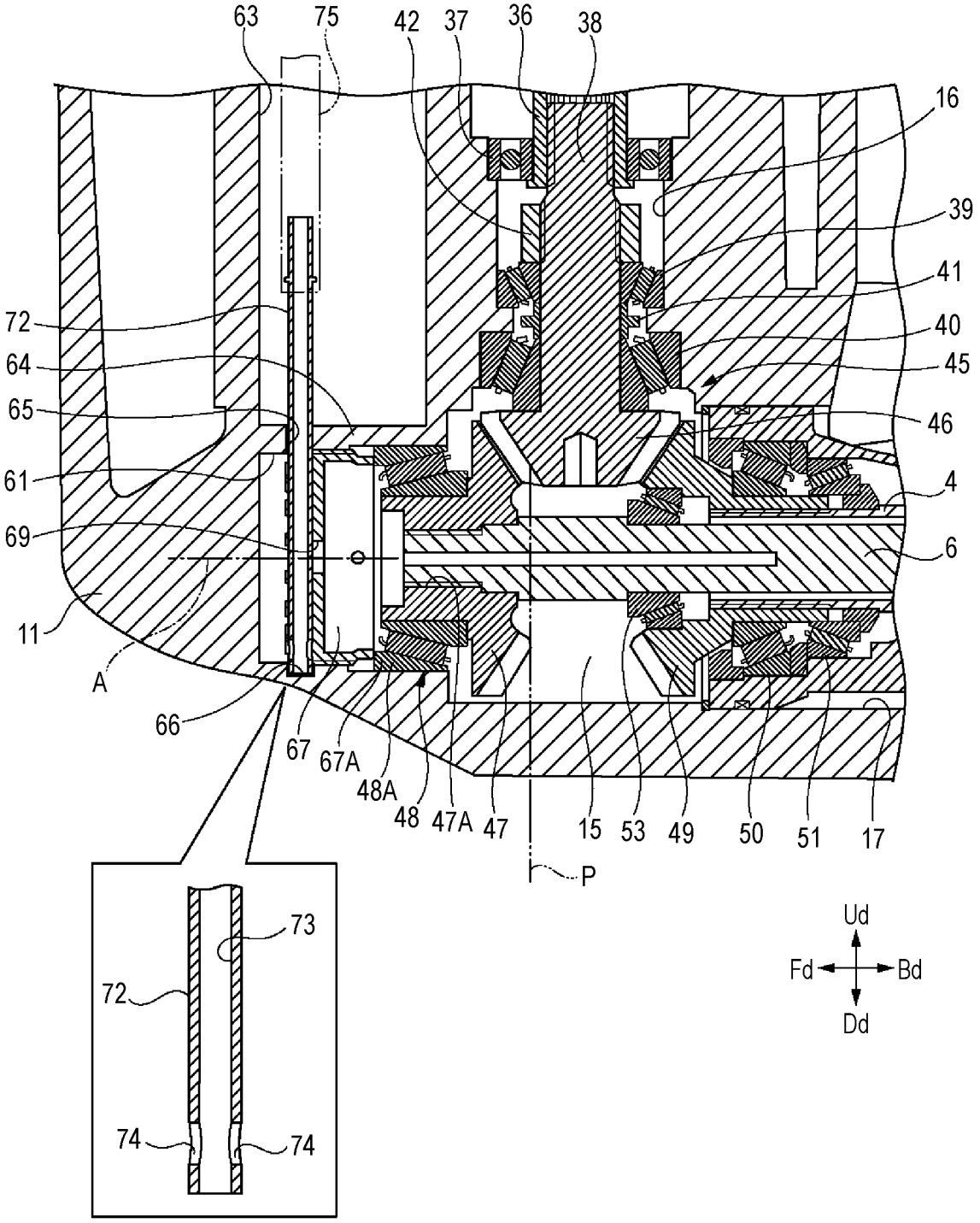
FIG. 4 is a sectional view showing an enlarged lower gear mechanism and the like in FIG. 2.

FIG. 4 is an enlarged view of the lower drive shaft 38, the lower gear mechanism 45, and the like in FIG. 2. The lower drive shaft 38 extends in the upper-lower direction, and is located below the intermediate drive shaft 35 and is coaxial with the intermediate drive shaft 35. As shown in FIG. 4, the lower drive shaft 38 is disposed in the drive shaft arrangement hole 16, and is rotatably supported to the drive shaft arrangement hole 16 by bearings 39, 40. A spacer 41 that sets the arrangement of inner rings of the bearings 39, 40 and a nut 42 that fixes the inner rings of the bearings 39, 40 to the lower drive shaft 38 are attached to the lower drive shaft 38.

The lower drive shaft 38 is integrally formed with a main drive gear 46 at a lower end portion thereof. The lower drive shaft 38 and the main drive gear 46 are integrally formed into one component, and are formed by, for example, forging and cutting.

(Lower Gear Mechanism and Propeller Shaft)

The lower gear mechanism 45 is a mechanism that transmits the power of the engine 2 transmitted through the upper drive shaft 21, the upper gear mechanism 22, the clutch 27, the intermediate drive shaft 35, the coupling member 36, and the lower drive shaft 38 to the outer propeller shaft 4 and the inner propeller shaft 6. The lower gear mechanism 45 is disposed in the lower gear chamber 15. As shown in FIG. 4, the lower gear mechanism 45 includes the main drive gear 46, a front driven gear 47, and a rear driven gear 49. Although the main drive gear 46 is integrally formed with the lower drive shaft 38, the main drive gear 46 is one of components of the lower gear mechanism 45 in terms of function. The main drive gear 46 is a specific example of a "drive gear", and the front driven gear 47 is a specific example of a "driven gear".

The main drive gear 46 is a bevel gear, and is disposed in an upper portion of the lower gear chamber 15 such that a portion formed with teeth faces downward.

The front driven gear 47 is a bevel gear and is disposed in a front portion of the lower gear chamber 15 such that a portion formed with teeth faces rearward. The front driven gear 47 is rotatably supported to the lower case 11 by a bearing 48. The front driven gear 47 is disposed in front of the main drive gear 46 and meshes with the main drive gear 46.

The rear driven gear 49 is a bevel gear, and is disposed in a rear portion of the lower gear chamber 15 such that a portion formed with teeth faces forward. The rear driven gear 49 is rotatably supported to the lower case 11 by a bearing 50. The rear driven gear 49 is disposed in rear of the main drive gear 46 and meshes with the main drive gear 46.

As shown in FIG. 2, the outer propeller shaft 4 is formed in a tubular shape and extends in the front-rear direction. A front end portion of the outer propeller shaft 4 is disposed in the propeller shaft arrangement hole 17, and the outer propeller shaft 4 is rotatably supported to the lower case 11 by bearings 51, 52. The rear driven gear 49 is splined (fitted) to the front end portion of the outer propeller shaft 4. Accordingly, the rear driven gear 49 and the outer propeller shaft 4 rotate integrally. The front propeller 3 is attached to a rear end portion of the outer propeller shaft 4.

The inner propeller shaft 6 extends in the front-rear direction, and a front portion of the inner propeller shaft 6 is disposed inside the outer propeller shaft 4. The inner propeller shaft 6 is coaxial with the outer propeller shaft 4. The inner propeller shaft 6 is supported to the outer propeller shaft 4 and the rear driven gear 49 by bearings 53, 54 in a manner of being rotatable relative to the outer propeller shaft 4 and the rear driven gear 49. The front driven gear 47 is splined (fitted) to a front end portion of the inner propeller shaft 6. Accordingly, the front driven gear 47 and the inner propeller shaft 6 rotate integrally. The rear propeller 5 is attached to a rear end portion of the inner propeller shaft 6.

When the main drive gear 46 rotates integrally with the lower drive shaft 38, the rotation is transmitted to the rear driven gear 49 and the front driven gear 47. As a result, the outer propeller shaft 4 and the inner propeller shaft 6 rotate. At this time, rotation directions of the outer propeller shaft 4 and the inner propeller shaft 6 are in reverse. As the outer propeller shaft 4 and the inner propeller shaft 6 rotate, the front propeller 3 and the rear propeller 5 also rotate.

When the positive rotation of the upper drive shaft 21 is transmitted to the outer propeller shaft 4 and the inner propeller shaft 6 by the clutch 27 through the intermediate drive shaft 35, the lower drive shaft 38, the lower gear mechanism 45, and the like, a propulsive force that moves a ship forward is generated by the front propeller 3 and the rear propeller 5. When the reverse rotation of the reverse output gear 25 is transmitted to the outer propeller shaft 4 and the inner propeller shaft 6 by the clutch 27 through the intermediate drive shaft 35, the lower drive shaft 38, the lower gear mechanism 45, and the like, a propulsive force that moves the ship backward is generated by the front propeller 3 and the rear propeller 5.

(Setting Member Arrangement Hole and Gear Position Setting Member)

Figure 5:
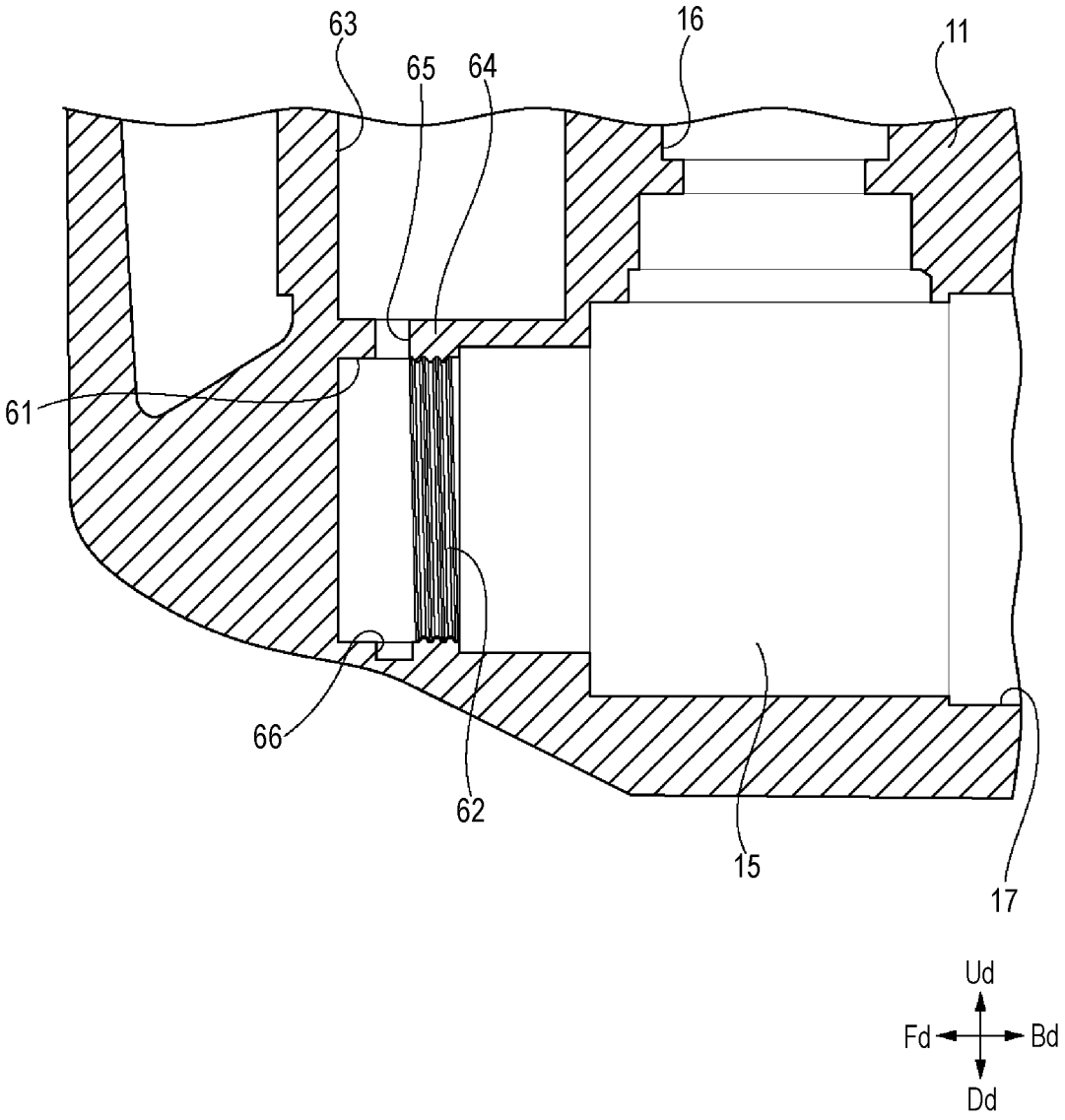
FIG. 5 is a sectional view showing a lower gear chamber in the outboard motor according to the embodiment of the present disclosure.

FIG. 5 shows the lower gear chamber 15 in a state where the lower gear mechanism 45 and the like is not provided. As shown in FIG. 5, the lower gear chamber 15 is formed with a setting member arrangement hole 61 in a front portion thereof in the lower case 11. The setting member arrangement hole 61 is a bottomed hole that extends forward from the lower gear chamber 15 and has a circular cross-sectional shape. The setting member arrangement hole 61 is coaxial with the front driven gear 47 disposed in the lower gear chamber 15. The setting member arrangement hole 61 is formed with, on a peripheral surface in the vicinity of an opening in a rear portion, a screw 62 having an axis extending in the front-rear direction. The screw 62 is a specific example of a "first screw".

As shown in FIG. 2, the lower case 11 is formed with, above the setting member arrangement hole 61, a vertical hole 63 extending downward from the upper portion of the lower case 11. As shown in FIG. 5, an insertion hole 65 is formed in a partition wall 64 between the vertical hole 63 and the setting member arrangement hole 61. The insertion hole 65 penetrates the partition wall 64 in the upper-lower direction, and a lower end of the insertion hole 65 is opened at an uppermost portion of the peripheral surface of the setting member arrangement hole 61. In addition, the insertion hole 65 is disposed at a front portion (portion on a back side) of the setting member arrangement hole 61, and is located in front of the screw 62. A stop hole 66 is formed in a lowermost portion of the peripheral surface of the setting member arrangement hole 61. The stop hole 66 is a bottomed hole extending downward from the lowermost portion of the peripheral surface of the setting member arrangement hole 61, and is located directly below the insertion hole 65 and is coaxial with the insertion hole 65. In the present embodiment, the insertion hole 65 and the stop hole 66 have the same diameter.

As shown in FIG. 4, a gear position setting member 67 is provided in the setting member arrangement hole 61. The gear position setting member 67 is located in front of the front driven gear 47. The gear position setting member 67 has a function of setting the position of the front driven gear 47 in the front-rear direction.

Figure 6:
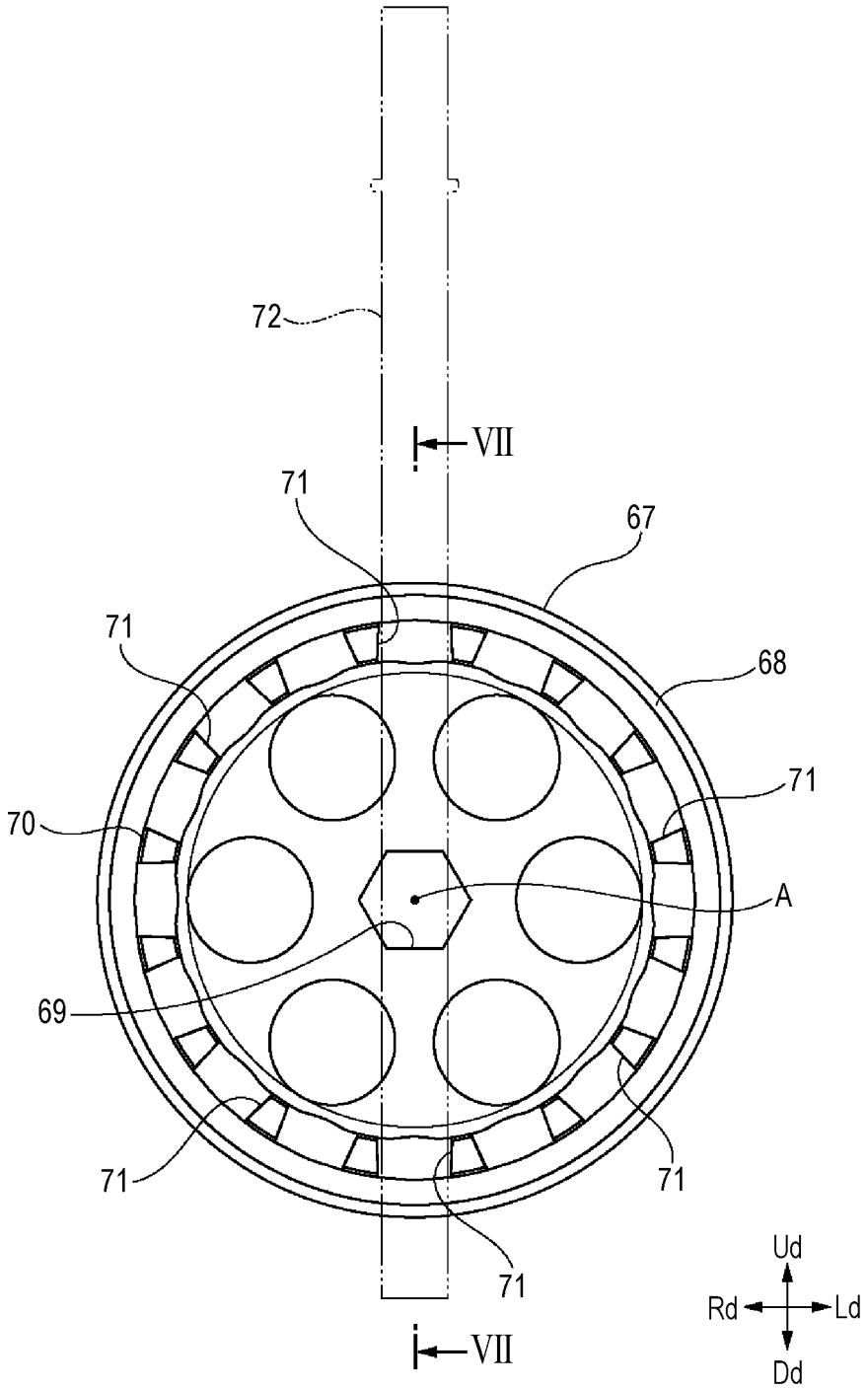
FIG. 6 is a schematic view showing a gear position setting member in the outboard motor according to the embodiment of the present disclosure as viewed from front.
Figure 7A:
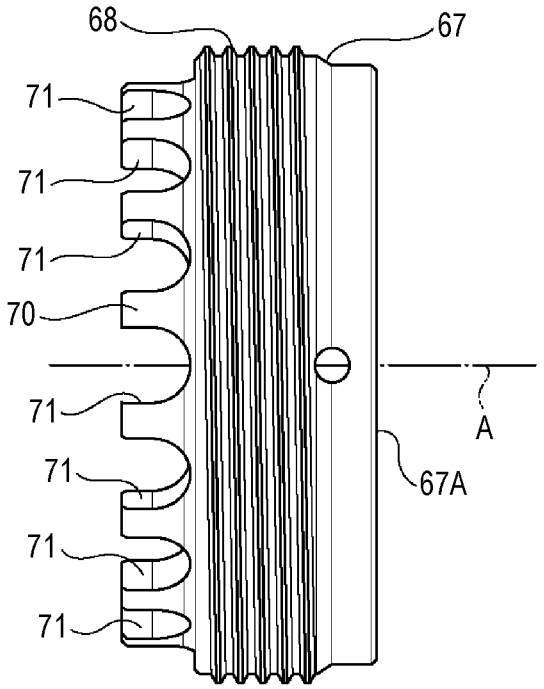
FIG. 7A is a schematic view showing the gear position setting member in FIG. 6 as viewed from left.
Figure 7B:
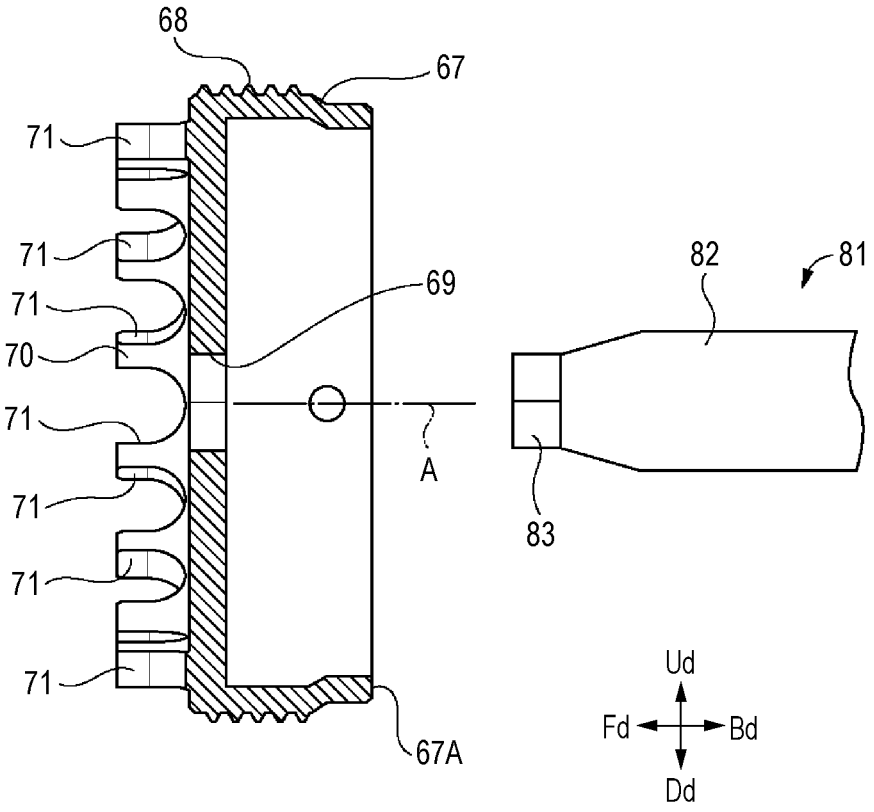
FIG. 7B is a schematic view showing a tool and a cross section of the gear position setting member taken along a cutting line VII-VII in FIG. 6.

FIG. 6 shows the gear position setting member 67 as viewed from front. FIG. 7A shows the gear position setting member 67 as viewed from left. FIG. 7B shows a cross section of the gear position setting member 67 cut along a cutting line VII-VII in FIG. 6 as viewed from left, as well as a tool 81.

As shown in FIGS. 6 and 7A, the gear position setting member 67 is made of, for example, a metal material, and has a bottomed cylindrical shape having an axis A extending in the front-rear direction. The gear position setting member 67 has an outer diameter set to a value slightly smaller than an inner diameter of the setting member arrangement hole 61 so that the gear position setting member 67 can rotate coaxially with the setting member arrangement hole 61 without being displaced in the upper-lower direction or in the left-right direction in the setting member arrangement hole 61. The gear position setting member 67 is coaxial with the front driven gear 47.

A screw 68 having an axis extending in the front-rear direction is formed on an outer peripheral surface of the gear position setting member 67. The screw 68 of the gear position setting member 67 is screwed to the screw 62 of the setting member arrangement hole 61. The screw 68 is a specific example of a "second screw".

The screw 62 of the setting member arrangement hole 61 and the screw 68 of the gear position setting member 67 constitute a screw mechanism that moves the gear position setting member 67 in the front-rear direction in the setting member arrangement hole 61 when the gear position setting member 67 is rotated about the axis A. When the gear position setting member 67 disposed in the setting member arrangement hole 61 is viewed from rear and the gear position setting member 67 is rotated clockwise, the screw 68 rotates clockwise relative to the screw 62 so that the gear position setting member 67 moves forward. On the other hand, when the gear position setting member 67 is rotated counterclockwise, the screw 68 is rotated counterclockwise relative to the screw 62 so that the gear position setting member 67 is moved rearward.

As shown in FIGS. 6 and 7B, a tool attachment hole 69 for attaching the tool 81, which rotates the gear position setting member 67 about the axis A, is provided in a central portion of the gear position setting member 67. The tool attachment hole 69 is a hole whose opening shape is a square (for example, a hexagon). As shown in FIG. 8C, the tool 81 includes, for example, a rod-shaped shaft portion 82 having a length for reaching the tool attachment hole 69 of the gear position setting member 67 disposed in the setting member arrangement hole 61 from rear of the lower case 11 and through the propeller shaft arrangement hole 17. As shown in FIG. 7B, the shaft portion 82 is provided with, at a tip end thereof, a fitting portion 83 having a rectangular (for example, hexagonal) cross section for being fittable into the tool attachment hole 69. The tool attachment hole 69 is a specific example of a "tool attachment portion".

As shown in FIG. 4, a rear end surface 67A of the outer peripheral portion of the gear position setting member 67 is in contact with a front end surface of an outer ring 48A of the bearing 48 that supports the front driven gear 47 to the lower case 11. When the gear position setting member 67 is rotated clockwise using the tool 81, the front driven gear 47 and the bearing 48 can be moved forward. When the gear position setting member 67 is rotated counterclockwise using the tool 81, the front driven gear 47 and the bearing 48 can be pushed and moved rearward.

As shown in FIG. 7A, an annular portion 70 protruding forward is formed on the outer peripheral portion of the gear position setting member 67, and a plurality of locking recesses 71 are formed on a front end of the annular portion 70 at equal intervals over the entire circumference. The number of the locking recesses 71 is an even number, for example, 16. As shown in FIG. 4, a fixing member 72 that non-rotatably fixes the gear position setting member 67 is attachably and detachably provided in the setting member arrangement hole 61 of the lower case 11. The fixing member 72 is a long tubular member formed of, for example, a metal material. The fixing member 72 is inserted into the insertion hole 65 formed in the partition wall 64 and the stop hole 66 formed in the peripheral surface of the setting member arrangement hole 61. The fixing member 72 has a diameter set to a value slightly smaller than the diameter of the insertion hole 65 and the stop hole 66 so that the fixing member 72 can be inserted into and removed from the insertion hole 65 and the stop hole 66 and is substantially exactly fitted into the insertion hole 65 and the stop hole 66. When the fixing member 72 is inserted into the insertion hole 65 and the stop hole 66, the fixing member 72 is engaged with, for example, two locking recesses 71 facing each other among the 16 locking recesses 71 of the gear position setting member 67 (see FIG. 6). Accordingly, the gear position setting member 67 is non-rotatably fixed in the setting member arrangement hole 61. Since the gear position setting member 67 is non-rotatably fixed by the fixing member 72, positions of the front driven gear 47 and the bearing 48 in the front-rear direction can be determined.

The fixing member 72 can be pulled out of the insertion hole 65 and the stop hole 66 by, for example, inserting a hand or a tool from the vertical hole 63. When the fixing member 72 is pulled out, the gear position setting member 67 can be rotated using the tool 81, and the positions of the front driven gear 47 and the bearing 48 in the front-rear direction can be changed by rotating the gear position setting member 67.

In the present embodiment, the fixing member 72 also functions as an oil supply pipe that supplies lubricating oil into the lower gear chamber 15. As shown on lower left of FIG. 4, the inside of the fixing member 72 is an oil flow portion 73 that flows the lubricating oil, and a lower end portion of the fixing member 72 is formed with an oil outflow hole 74 through which the lubricating oil flows out into the lower gear chamber 15. An oil introduction pipe 75 through which the lubricating oil flows into the fixing member 72 from the outside of the lower case 11 can be connected to an upper end portion of the fixing member 72.

(Assembly of Lower Drive Shaft)

FIGS. 8A to 8D show an operation process of assembling the lower drive shaft 38 integrally formed with the main drive gear 46 into the lower case 11. In FIGS. 8A to 8D and 4, P indicates a position where the front driven gear 47 meshes with the main drive gear 46 (specifically, a position in the front-rear direction of a rear end (tip end) of the front driven gear 47 in a state where the front driven gear 47 meshes with the main drive gear 46). Hereinafter, this position is referred to as a "set position P".

In the outboard motor 1 of the present embodiment, the operation process of assembling the lower drive shaft 38 into the lower case 11 is as follows.

First step: First, the operator rotates the gear position setting member 67 provided in the setting member arrangement hole 61 using the tool 81, and moves the gear position setting member 67 to, for example, the vicinity of a foremost position in the setting member arrangement hole 61. In this state, the operator inserts the bearing 48 and the front driven gear 47 into the lower gear chamber 15 from rear of the lower case 11 through the propeller shaft arrangement hole 17, and attaches the bearing 48 and the front driven gear 47 to the front portion of the lower gear chamber 15. Further, the operator pushes the bearing 48 and the front driven gear 47 forward so that the front end surface of the outer ring 48A of the bearing 48 comes into contact with the rear end surface 67A of the gear position setting member 67. Accordingly, the front driven gear 47 is disposed in front of the set position P. In this way, since the gear position setting member 67 is moved to, for example, the vicinity of the foremost position in the setting member arrangement hole 61, the front driven gear 47 can be disposed in front of the setting position P.

Figure 8A:
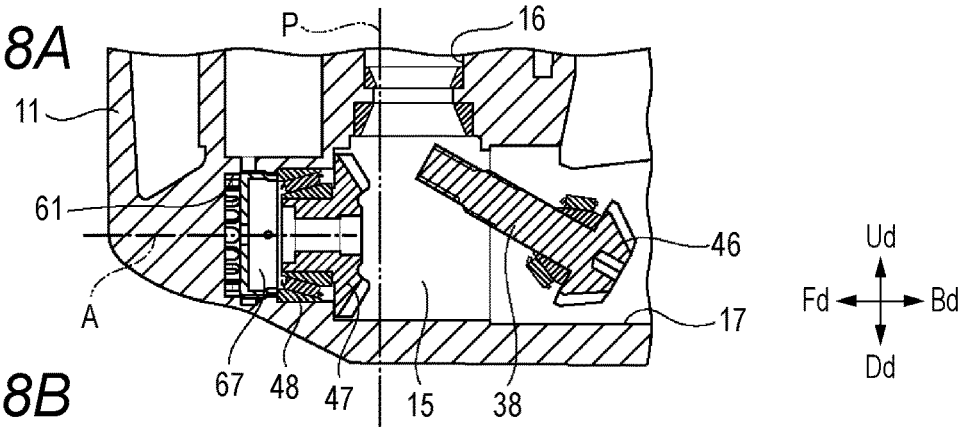
FIGS. 8A to 8D are schematic views showing a drive shaft assembling operation process according to the embodiment of the present disclosure.

Second step: as shown in FIG. 8A, in a state where the front driven gear 47 is disposed in front of the set position P, the operator inserts the lower drive shaft 38 into the lower gear chamber 15 from rear of the lower case 11 through the propeller shaft insertion hole 65. At this time, the operator inserts the lower drive shaft 38 into the propeller shaft arrangement hole 17 starting from an end portion (upper end portion) of the lower drive shaft 38 on a side where the main drive gear 46 is not integrally formed, and carries the lower drive shaft 38 into the lower gear chamber 15.

Figure 8B:
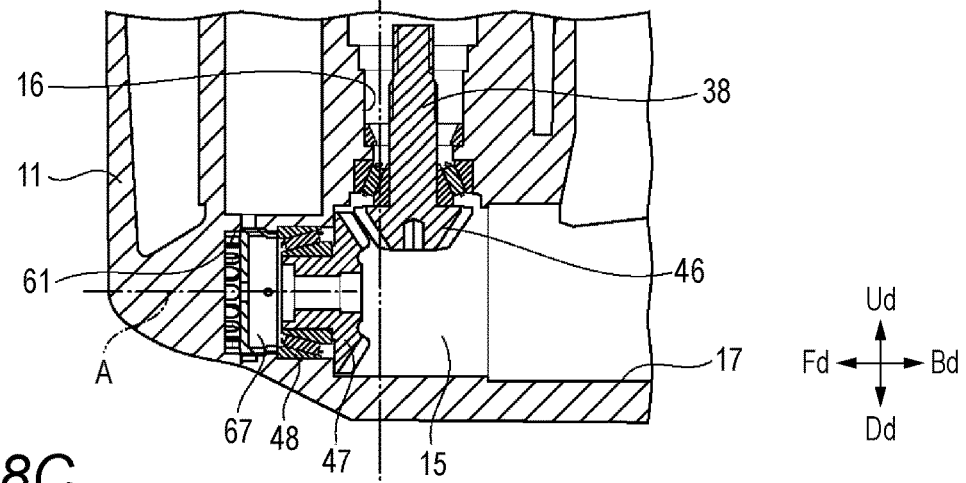
Figure 8C:
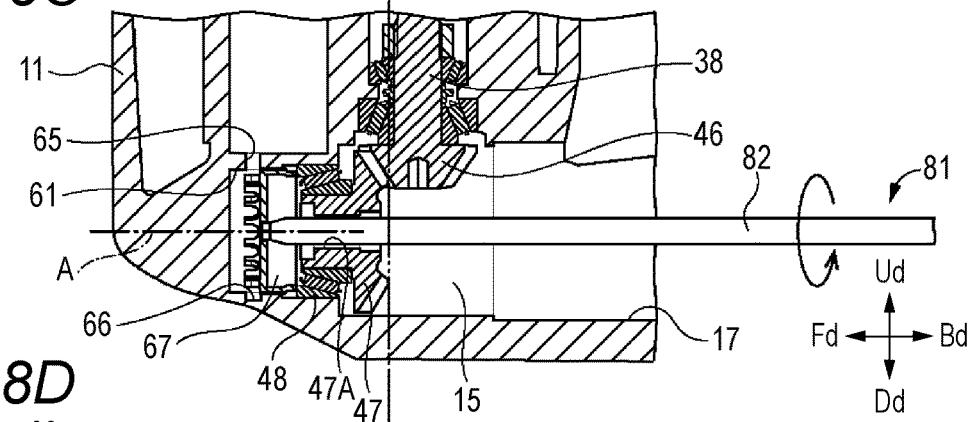

Third step: Next, the operator inserts the lower drive shaft 38 into the drive shaft arrangement hole 16 from below as shown in FIG. 8B while rotating the lower drive shaft 38 inserted into the lower gear chamber 15 such that the end portion of the lower drive shaft 38 on the side where the main drive gear 46 is not integrally formed faces upward. Then, the lower drive shaft 38 is attached to the drive shaft arrangement hole 16.

Fourth step: Next, as shown in FIG. 8C, the operator inserts the tool 81 into the propeller shaft arrangement hole 17 from rear of the lower case 11, further passes the tool 81 through the shaft hole 47A of the front driven gear 47, and fits the fitting portion 83 provided at the tip end of the tool 81 to the tool attachment hole 69 of the gear position setting member 67.

Fifth step: Next, the operator rotates the gear position setting member 67 and moves the gear position setting member 67 rearward by rotating the tool 81 in a direction of an arrow in FIG. 8C. Accordingly, the bearing 48 and the front driven gear 47 are pushed by the gear position setting member 67 and move rearward. The operator rotates the tool 81, moves the front driven gear 47 to the set position P, and meshes the front driven gear 47 with the main drive gear 46.

Figure 8D:
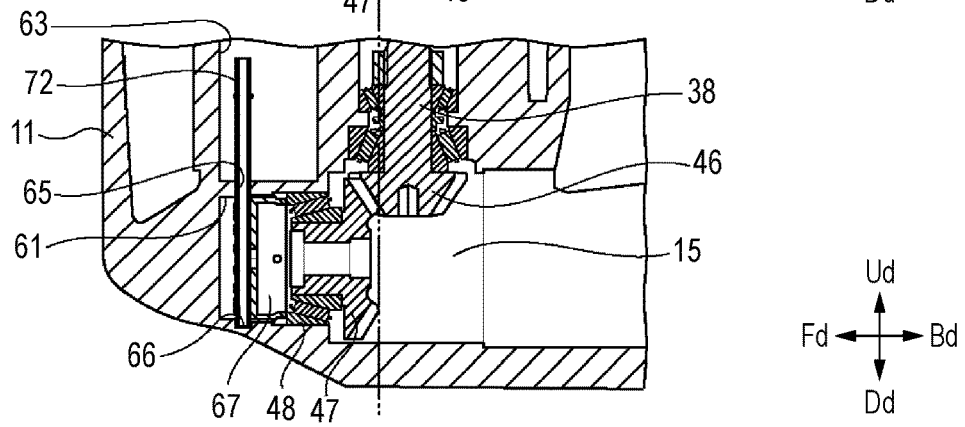

Sixth step: Next, as shown in FIG. 8D, the operator inserts the fixing member 72 into the vertical hole 63 from above the lower case 11, and sequentially inserts the fixing member 72 into the insertion hole 65, the locking recesses 71 of the gear position setting member 67, and the stop hole 66. Accordingly, the gear position setting member 67 is non-rotatably fixed in the setting member arrangement hole 61, the position of the gear position setting member 67 in the front-rear direction is fixed, and the position of the front driven gear 47 in the front-rear direction is set to the setting position P.

At the time of manufacturing the outboard motor 1, after the lower drive shaft 38 integrally formed with the main drive gear 46 and the front driven gear 47 are assembled into the lower case 11 in this way, for example, the operator assembles the rear driven gear 49, the inner propeller shaft 6, and the outer propeller shaft 4 into the lower gear chamber 15 and the propeller shaft arrangement hole 17, couples the intermediate drive shaft 35 to the lower drive shaft 38 by the coupling member 36, assembles the upper gear mechanism 22 and the clutch 27 into the upper gear chamber 14, and the like.

The second step and the third step are specific examples of a "drive shaft inserting step". The fourth step is a specific example of a "tool attaching step". The fifth step is a specific example of a "driven gear moving step".

(Adjustment of Mesh Between Main Drive Gear and Front Driven Gear)

In the outboard motor 1 of the present embodiment, the operator can adjust the mesh (tooth contact, backlash, and the like) between the main drive gear 46 and the front driven gear 47 as follows. First, the operator detaches the rear driven gear 49, the inner propeller shaft 6, and the outer propeller shaft 4 from the lower case 11. Next, the operator rotates the gear position setting member 67 using the tool 81 to change the position of the front driven gear 47 in the front-rear direction, thereby adjusting the mesh between the main drive gear 46 and the front driven gear 47. Next, the operator assembles the rear driven gear 49, the inner propeller shaft 6, and the outer propeller shaft 4 to the lower case 11.

As described above, the outboard motor 1 of the present embodiment includes the gear position setting member 67 that sets the position of the front driven gear 47 in the front-rear direction, and the screw mechanism (screw 62, screw 68) that moves the gear position setting member 67 in the front-rear direction when the gear position setting member 67 is rotated about the axis A. Accordingly, by changing the position of the front driven gear 47 in the front-rear direction, the lower drive shaft 38 integrally formed with the main drive gear 46 can be assembled into the lower case 11. That is, according to the outboard motor 1 of the present embodiment, by moving the gear position setting member 67 forward, the front driven gear 47 attached to the inside of the lower gear chamber 15 can be moved forward from the set position P. Accordingly, the front driven gear 47 can be moved away from the opening of the drive shaft arrangement hole 16 into the lower gear chamber 15. As a result, in the lower gear chamber 15, a vacant region below the drive shaft arrangement hole 16 can be expanded. Therefore, when the lower drive shaft 38 integrally formed with the main drive gear 46 is inserted into the drive shaft arrangement hole 16 from below through the propeller shaft arrangement hole 17 and the lower gear chamber 15 from rear of the lower case 11, it is possible to prevent the front driven gear 47 from coming into contact with the lower drive shaft 38 or the main drive gear 46 and from interfering with the insertion of the lower drive shaft 38 into the drive shaft arrangement hole 16. Therefore, by the method for attaching the lower drive shaft 38 integrally formed with the main drive gear 46 to the drive shaft arrangement hole 16 by inserting the lower drive shaft 38 integrally formed with the main drive gear 46 into the drive shaft arrangement hole 16 from below through the propeller shaft arrangement hole 17 and the lower gear chamber 15 from rear of the lower case 11, the lower drive shaft 38 integrally formed with the main drive gear 46 can be assembled into the lower case 11.

According to the outboard motor 1 of the present embodiment, since the lower drive shaft 38 integrally formed with the main drive gear 46 can be attached to the inside of the drive shaft arrangement hole 16 from below through the propeller shaft arrangement hole 17 and the lower gear chamber 15 of the lower case 11, the lower drive shaft 38 integrally formed with the main drive gear 46 can be assembled into the lower case 11 without adding a large-diameter hole for passing the main drive gear 46 integrally formed with the lower drive shaft 38 to the lower case 11. Therefore, it is possible to prevent the lateral width of the lower case 11 from increasing due to adding a large-diameter hole to the lower case 11, and it is possible to prevent the resistance of water from increasing during navigation.

According to the outboard motor 1 of the present embodiment, since the gear position setting member 67 and the screw mechanism (screws 62, 68) are provided, it is possible to easily and quickly adjust the mesh between the main drive gear 46 and the front driven gear 47 by changing the position of the front driven gear 47 in the front-rear direction. That is, in the outboard motor in the related art, the mesh between the drive gear and the front driven gear is adjusted by a method of replacing a shim attached to a boss of the front driven gear with another shim having a different thickness. For this reason, to adjust the mesh between the drive gear and the front driven gear, it is necessary to detach the drive gear and the front driven gear from the lower case. In contrast, according to the outboard motor 1 of the present embodiment, the mesh between the main drive gear 46 and the front driven gear 47 can be adjusted by changing the position of the front driven gear 47 in the front-rear direction in a state where the main drive gear 46 and the front driven gear 47 are attached to the lower case 11. Therefore, when the mesh between the main drive gear 46 and the front driven gear 47 is adjusted, the step of attaching and detaching the main drive gear 46 and the front driven gear 47 to and from the lower case 11 can be omitted. Therefore, it is possible to reduce the number of operation steps for adjusting the mesh between the main drive gear 46 and the front driven gear 47, and it is possible to facilitate and speed up the operation for adjusting the mesh. According to the present embodiment, such an operational effect can be obtained by a simple structure in which the gear position setting member 67 is moved by the screw mechanism.

In the outboard motor 1 of the present embodiment, the tool attachment hole 69 for attaching the tool 81 that rotates the gear position setting member 67 is provided in the central portion of the gear position setting member 67. With this configuration, the tool 81 is attached to the gear position setting member 67 from rear of the lower case 11 through the propeller shaft arrangement hole 17 and the shaft hole 47A of the front driven gear 47, and the gear position setting member 67 is rotated using the tool 81, so that the position of the front driven gear 47 in the front-rear direction can be easily changed. Therefore, the lower drive shaft 38 integrally formed with the main drive gear 46 can be easily assembled into the lower case 11, and the mesh between the main drive gear 46 and the front driven gear 47 can be easily adjusted.

The outboard motor 1 of the present embodiment includes the fixing member 72 that is attachably and detachably provided in the setting member arrangement hole 61 formed in the lower gear chamber 15 and that non-rotatably fixes the gear position setting member 67. With this configuration, the operator can switch between a state in which the gear position setting member 67 is movable in the front-rear direction and a state in which the gear position setting member 67 is not movable in the front-rear direction simply by attaching and detaching the fixing member 72 to and from the setting member arrangement hole 61. Therefore, the lower drive shaft 38 integrally formed with the main drive gear 46 can be more easily assembled into the lower case 11, and the mesh between the main drive gear 46 and the front driven gear 47 can be more easily adjusted. In particular, according to the present embodiment, since the gear position setting member 67 can be switched between the state in which the gear position setting member 67 is movable in the front-rear direction and the state in which the gear position setting member 67 is not movable in the front-rear direction simply by inserting and removing the fixing member 72 into and from the insertion hole 65, the stop hole 66, and the locking recesses 71 of the gear position setting member 67, the assembly of the lower drive shaft 38 and the mesh adjustment can be performed more easily.

In the outboard motor 1 of the present preferred embodiment, the intermediate drive shaft 35 and the lower drive shaft 38 are coupled by the coupling member 36. With this configuration, it is possible to reduce the length of the lower drive shaft 38 integrally formed with the main drive gear 46. Therefore, the lower drive shaft 38 integrally formed with the main drive gear 46 can be smoothly inserted into the drive shaft arrangement hole 16 from below after passing through the propeller shaft arrangement hole 17 and the lower gear chamber 15 from rear of the lower case 11.

In the present embodiment, the fixing member 72 has a function of an oil supply pipe that supplies the lubricating oil into the lower gear chamber 15, in addition to a function of fixing the gear position setting member 67. Accordingly, the number of oil supply pipes can be reduced, and the number of components of the outboard motor 1 can be reduced.

In the present embodiment, since the main drive gear 46 is formed integrally with the lower drive shaft, the coupling strength between the lower drive shaft 38 and the main drive gear 46 can be increased. Therefore, the stability of power transmission from the lower drive shaft 38 to the propeller shafts 4, 6 can be enhanced.

Figure 9A:
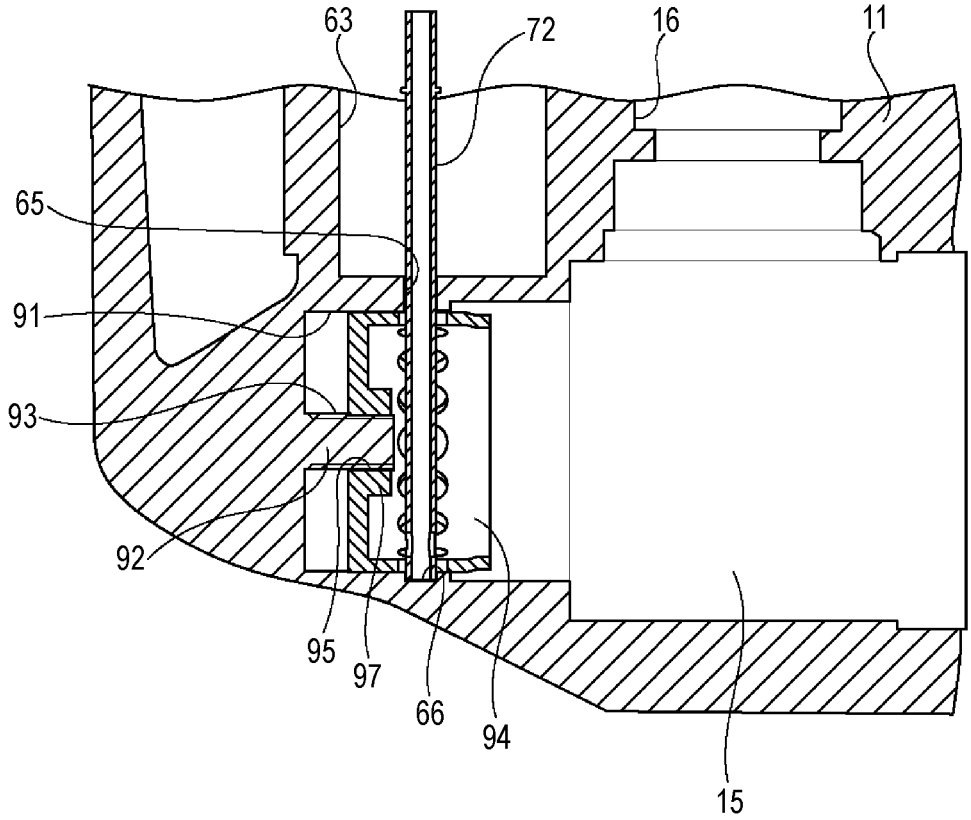
FIGS. 9A to 9C are schematic views showing another embodiment of a screw mechanism, a tool attachment portion, and the like of the outboard motor of the present disclosure.
Figure 9B:
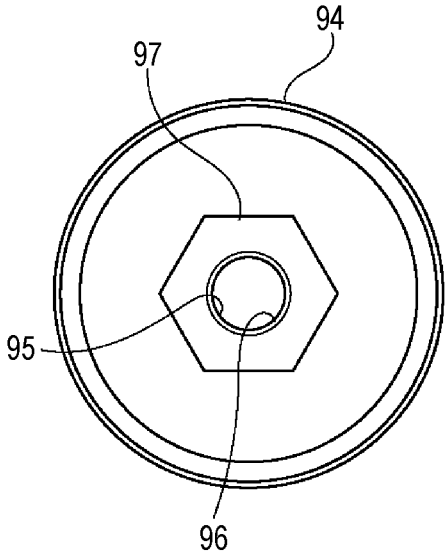
Figure 9C:
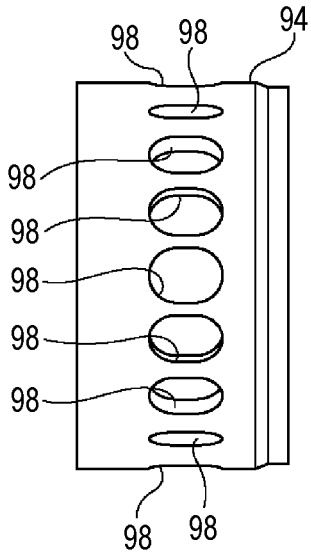
Figure 10A:
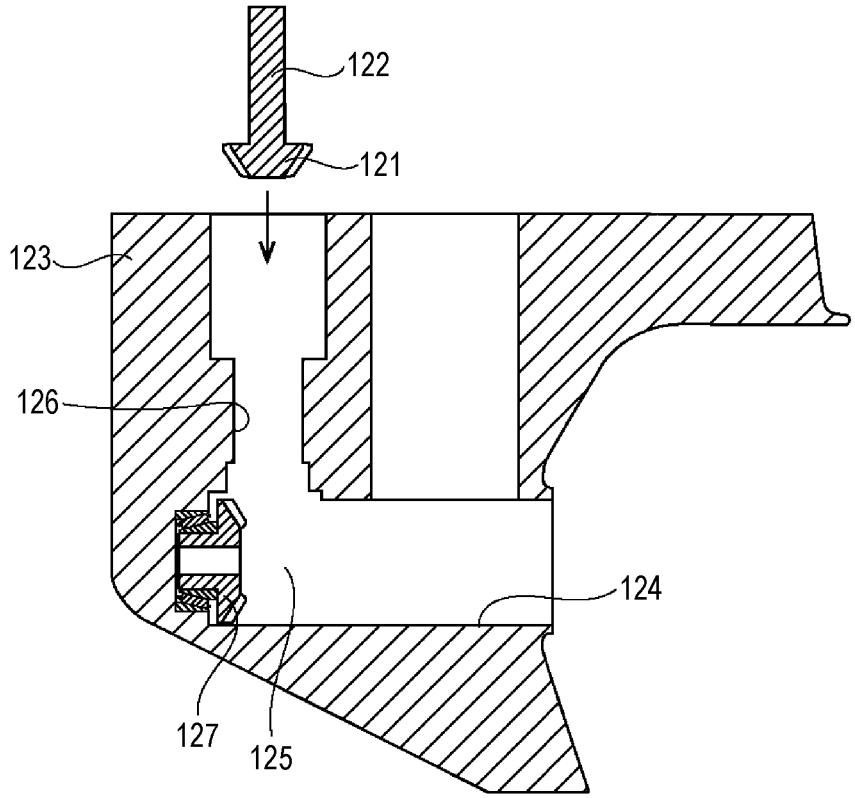
FIGS. 10A and 10B are schematic views showing difficulties in assembling a drive shaft integrally formed with a drive gear into a lower case in an outboard motor in the related art.
Figure 10B:
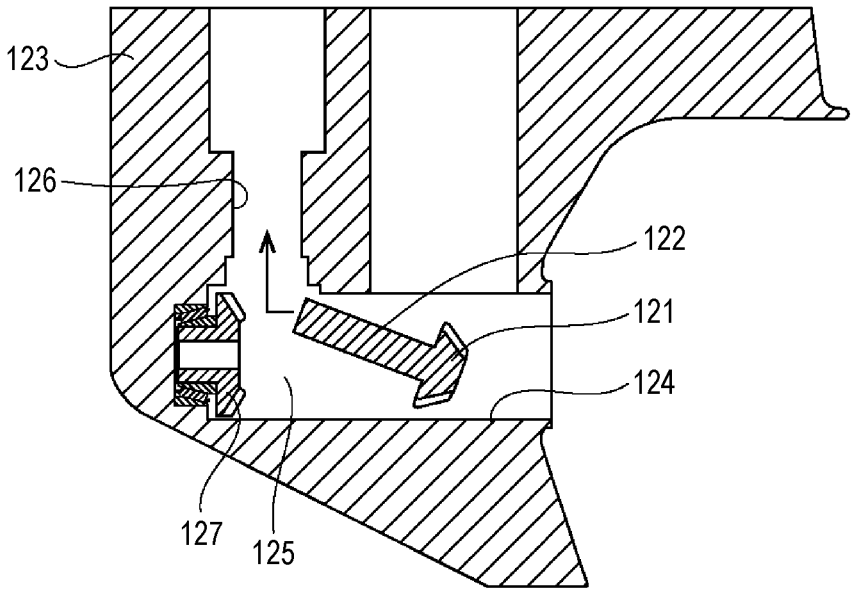

The screw mechanism that moves the gear position setting member in the front-rear direction when the gear position setting member is rotated is not limited to the screws 62, 68 of the above-described embodiment. The tool attachment portion of the gear position setting member is not limited to the tool attachment hole 69 of the above-described embodiment. The configuration of a locking portion that engages with the fixing member and disables the rotation of the gear position setting member is not limited to the locking recesses 71 of the above-described embodiment. As shown in FIGS. 9A to 9C, the screw mechanism may be configured such that a protruding portion 92 protruding rearward from the center of a setting member arrangement hole 91 is provided on a front surface (bottom surface) of the setting member arrangement hole 91, a screw 93 is formed on an outer peripheral surface of the protruding portion 92, a screw hole 95 formed with a screw 96 on an inner peripheral surface is formed in a center portion of a front portion (bottom portion) of a gear position setting member 94 formed in a bottomed cylindrical shape, the protruding portion 92 is inserted into the screw hole 95, and the screw 96 and the screw 93 are screwed together. The tool attachment portion may be configured such that a tool attachment protrusion 97, which protrudes rearward from the central portion of the gear position setting member 94 and has a rectangular (for example, hexagonal) cross section, is provided on the front portion (bottom portion) of the gear position setting member 94. The locking portion may be configured such that locking holes 98 that are elongated in the front-rear direction are provided in a peripheral wall of the gear position setting member 94.

In the above embodiment, the tubular fixing member 72 having the function of an oil supply pipe is described as an example, and the fixing member may be a simple pin-shaped or rod-shaped member not having the function of an oil supply pipe.

The present disclosure is not limited to a contra-rotating propeller outboard motor. The present disclosure can also be applied to an outboard motor including one propeller shaft as long as the outboard motor includes a drive gear coupled to a lower end side of a drive shaft and a driven gear meshing with the drive gear from front of the drive gear.

The present disclosure can be appropriately changed without departing from the gist or idea of the disclosure that can be read from the claims and the entire specification, and an outboard motor and a drive shaft assembling method accompanied by such a change are also included in the technical idea of the present disclosure.

What is claimed is:

1. An outboard motor comprising:

a case having a gear chamber, a drive shaft arrangement hole communicating with the gear chamber from above the gear chamber, and a propeller shaft arrangement hole communicating with the gear chamber from rear of the gear chamber;

a drive shaft disposed in the drive shaft arrangement hole and extending in an upper-lower direction;

a propeller shaft disposed in the propeller shaft arrangement hole and extending in a front-rear direction;

a drive gear disposed in the gear chamber and coupled to a lower end side of the drive shaft, the drive gear being a bevel gear;

a driven gear disposed in front of the drive gear in the gear chamber, coupled to a front end side of the propeller shaft, and configured to mesh with the drive gear, the driven gear being a bevel gear;

a gear position setting member provided in front of the driven gear in the case and configured to set a position of the driven gear in the front-rear direction; and a screw mechanism configured to move the gear position setting member in the front-rear direction when the gear position setting member is rotated about an axis of the gear position setting member, the axis of the gear position setting member extending in the front-rear direction, wherein the screw mechanism includes a first screw provided in the case and having an axis extending in the front-rear direction, and a second screw provided on the gear position setting member, having an axis extending in the front-rear direction, and configured to be screwed with the first screw.

2. The outboard motor according to claim 1, wherein the gear position setting member is formed in a columnar shape or a bottomed cylindrical shape having an axis extending in the front-rear direction, and wherein the gear position setting member is provided with, a tool attachment portion to which a tool that rotates the gear position setting member is attached, at a central portion of the gear position setting member.

3. The outboard motor according to claim 1, further comprising:

a fixing member attachably and detachably provided in the case and configured to non-rotatably fix the gear position setting member to the case.

4. The outboard motor according to claim 1, wherein the drive gear is formed integrally with the drive shaft.

5. A drive shaft assembling method for an outboard motor, the outboard motor including: a case having a gear chamber, a drive shaft arrangement hole communicating with the gear chamber from above the gear chamber, and a propeller shaft arrangement hole communicating with the gear chamber from rear of the gear chamber; a drive shaft disposed in the drive shaft arrangement hole and extending in an upper-lower direction; a propeller shaft disposed in the propeller shaft arrangement hole and extending in a front-rear direction; a drive gear disposed in the gear chamber and integrally formed with a lower end side of the drive shaft, the drive gear being a bevel gear; a driven gear disposed in front of the drive gear in the gear chamber, coupled to a front end side of the propeller shaft, and configured to mesh with the drive gear, the driven gear being a bevel gear; a gear position setting member provided in front of the driven gear in the case and configured to set a position of the driven gear in the front-rear direction; and a screw mechanism configured to move the gear position setting member in the front-rear direction when the gear position setting member is rotated about an axis of the gear position setting member that extends in the front-rear direction, the drive shaft assembling method for assembling the drive shaft integrally formed with the drive gear into the case, and the drive shaft assembling method comprising:

inserting the drive shaft into the drive shaft insertion hole from the gear chamber after inserting the drive shaft into the gear chamber through the propeller shaft insertion hole in a state where the driven gear is disposed in front of a set position where the driven gear is meshed with the drive gear;

inserting a tool that rotates the gear position setting member into the gear chamber through the propeller shaft insertion hole and attaching the tool to the gear position setting member; and rotating the gear position setting member by the tool to move the driven gear to the set position to mesh with the drive gear.

* * * * *